US010234078B2

(12) United States Patent
Marinus et al.

(10) Patent No.: US 10,234,078 B2
(45) **Date of Patent: *Mar. 19, 2019**

(54) LED LIGHT SOURCE AND LAMP COMPRISING SUCH A LED LIGHT SOURCE

(71) Applicant: PHILIPS LIGHTING HOLDING B.V., Eindhoven (NL)

(72) Inventors: Antonius Adrianus Maria Marinus, Eindhoven (NL); Peter Deixler, Valkenswaard (NL); Vincent Stefan David Gielen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 55 days.

This patent is subject to a terminal disclaimer.

(21) Appl. No.: 14/168,039

(22) Filed: Jan. 30, 2014

(65) Prior Publication Data

US 2015/0159814 A1 Jun. 11, 2015

Related U.S. Application Data

(63) Continuation of application No. 13/139,051, filed as application No. PCT/IB2009/055479 on Dec. 3, 2009, now Pat. No. 8,669,704.

(30) Foreign Application Priority Data

Dec. 12, 2008 (EP) ..... 08171555

(51) Int. Cl.
*H01J 7/44* (2006.01)
*G05F 1/00* (2006.01)
(Continued)

(52) U.S. Cl.
CPC ..... *F21K 9/135* (2013.01); *F21K 9/232* (2016.08); *H05B 33/0803* (2013.01); *H05B 33/0809* (2013.01); *H05B 33/0827* (2013.01)

(58) Field of Classification Search
CPC ..... H05B 33/0815; H05B 33/0818; H05B 37/029; H05B 41/3925; H05B 41/2828;
(Continued)

(56) References Cited

U.S. PATENT DOCUMENTS 6,161,910 A 12/2000 Reisenquer et al.
6,580,228 B1 6/2003 Chen et al.
(Continued)

FOREIGN PATENT DOCUMENTS

JP 2001184938 A 7/2001
JP 2002015606 A 1/2002
(Continued)

*Primary Examiner* — Seokjin Kim
(74) *Attorney, Agent, or Firm* — Akarsh P. Belagodu

(57) ABSTRACT

A LED light source comprises:

a first rectifier with a first and a second input terminal for connection to an AC supply voltage source and a first and a second output terminal connected by a first LED-string, a second rectifier having a first and a second input terminal and output terminals, said first input terminal of said second rectifier being coupled to the first input terminal of the first rectifier and the second input terminal of the second rectifier being coupled to the second input terminal of the first rectifier, and the output terminals being connected by a second LED-string, and means for causing a phase shift between the voltages that are present during operation at the output terminals of the first rectifier and the output terminals of the second rectifier respectively.

The LED strings are driven by very simple circuitry that can be supplied by mains supply voltage. Due to the phase shift stroboscopic effects are suppressed.

7 Claims, 7 Drawing Sheets

(51) Int. Cl.
*F21K 99/00* (2016.01)
*H05B 33/08* (2006.01)
*F21K 9/232* (2016.01)

(58) Field of Classification Search
CPC ..... H05B 33/0803; F21K 9/20; F21K 9/23; F21K 9/27
USPC ..... 362/219, 225, 236, 238, 240, 249.02
See application file for complete search history.

(56) References Cited

U.S. PATENT DOCUMENTS 7,408,304 B1 * 8/2008 Lin et al. ..... 315/169.1
8,354,800 B2 * 1/2013 Stack ..... H05B 33/0809 315/201
2007/0025109 A1 2/2007 Yu
2007/0070622 A1 * 3/2007 Allen ..... 362/234
2007/0115656 A1 * 5/2007 Chou ..... F21S 48/1154 362/228
2007/0146256 A1 * 6/2007 Wu ..... H05B 33/0818 345/83
2008/0054814 A1 3/2008 Deppe et al.
2009/0086484 A1 * 4/2009 Johnson ..... F21S 8/02 362/236
2010/0002440 A1 * 1/2010 Negley ..... F21K 9/00 362/249.14
2010/0102729 A1 * 4/2010 Katzir ..... H05B 33/0803 315/113
2010/0134016 A1 * 6/2010 York ..... F21K 9/54 315/113
2011/0089804 A1 * 4/2011 Mahalingam ..... F21V 3/00 313/46

FOREIGN PATENT DOCUMENTS

JP 2003178721 A 6/2003
RU 2347975 C2 2/2009
TW 200834496 A 8/2008
WO 2005120134 A1 12/2005
WO 2008135927 A1 11/2008
WO 2010058325 A1 5/2010

* cited by examiner

LED LIGHT SOURCE AND LAMP COMPRISING SUCH A LED LIGHT SOURCE

FIELD OF THE INVENTION

This invention relates to a LED light source that is suitable to be supplied by the mains and to a lamp comprising such a LED light source.

BACKGROUND OF THE INVENTION

A very cheap way of supplying current to a LED string is by connecting the LED string to the output terminals of a rectifier. During operation the input terminals of the rectifier are connected to the mains supply and at the output terminals the rectified mains is present across the LED string so that a current flows through the LED string.

SUMMARY OF THE INVENTION

In the direct vicinity of the zero crossings of the mains voltage, the voltage across the LED string is too low to cause a current to flow through the LED string. As a consequence the current through the LED string is interrupted with a frequency that equals twice the mains frequency. In steady state operation no flickering is perceived, but illuminating a moving object creates stroboscopic artefacts.

These stroboscopic artefacts can be suppressed to a large extent, in case a LED light source is used that comprises two LED strings and a phase shift is realized between the currents in the first LED string and in the second LED string. Such a phase shift can be realized by connecting each of the LED strings to output terminals of a different rectifier. A first rectifier is for instance connected directly to the mains supply or via components not causing a phase shift and a second rectifier is for instance connected to the mains via a reactive component causing a phase shift such as a capacitive element or an inductive element. Output terminals of the first rectifier are connected to the first LED string and output terminals of the second rectifier are connected to the second LED string. When the current through one of the LED strings is zero, the current through the other LED string is not, due to the phase shift. As a consequence the stroboscopic artefacts are suppressed to a large extent. Preferably, the phase shift between the current through the first LED string and the current through the second LED string is approximately 90 degrees.

It is possible to suppress the stroboscopic artefacts also in case the LED light source comprises three or more LED strings and the current through the subsequent LED strings is shifted approximately 180/n degrees, wherein n is the number of LED strings. In order to realize this phase shift the LED light source must comprise at least a third rectifier and a second reactive element.

The duty cycle of the current through a LED string (i. e. the ratio of the time lapse during which the LED string conducts a current and the duration of half a period of the mains supply) increases when the voltage drop across the LED string is decreased. This can be done by placing part of the LEDs comprised in the LED string in parallel. In case the voltage drop across the LED string supplied by the reactive current is lower than the voltage drop across the other LED string, the phase shift between the currents through the LED strings is increased.

The light source described here-above is very suitable for use in a LED lamp comprising a lamp vessel, electric contacts for connection to a supply source, a heat sink that is at least partly comprised in the lamp vessel, the space surrounded by the lamp vessel being divided into a number of compartments, each of which is at least in part confined by a wall of the lamp vessel and the heat sink. The LEDs comprised in each of the LED strings of the LED light source are connected to the heat sink and are distributed over at least part of the compartments.

In a preferred embodiment, the LED lamp comprises a lamp cap, a lamp bulb connected to the lamp cap and divided into two or more parts, a heat sink present between the parts of the lamp bulb and dividing a space within the lamp into a number of compartments equal to the number of parts of the lamp bulb, wherein the LEDs comprised in each of the LED strings are connected to the heat sink and are evenly distributed over the compartments.

BRIEF DESCRIPTION OF THE DRAWINGS

Embodiments of the invention will be described in more detail making use of a drawing. In the drawing

DETAILED DESCRIPTION OF EMBODIMENTS

Figure 1:
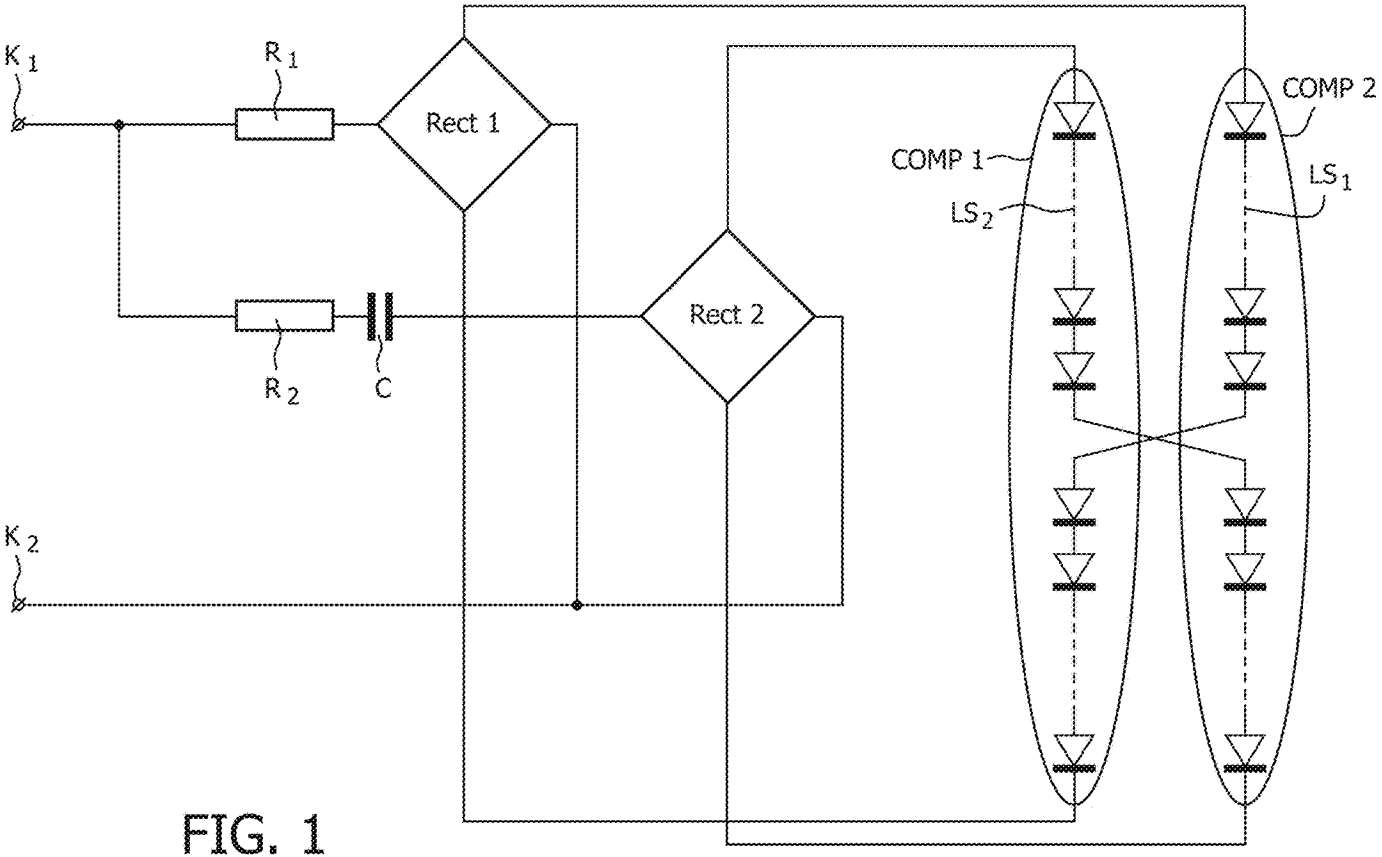
FIG. 1 shows an embodiment of a LED light source according to the invention and the distribution of LEDs comprised in the LED strings over compartments of an embodiment of a LED lamp according to the invention.

In FIGS. 1, K1 and K2 are input terminals for connection to the mains supply. Input terminal K1 is connected via an ohmic resistor R1 to a first input terminal of rectifier bridge Rect1 and also via an ohmic resistor R2 and a capacitor C to a first input terminal of a second rectifier bridge Rect2. The capacitor C forms a reactive element. Input terminal K2 is connected to a second input terminal of the first rectifier bridge Rect1 and to a second input terminal of the second rectifier bridge Rect2. A first output terminal of the first rectifier bridge Rect1 is connected to a first end of LED string LS1. A second end of LED string LS1 is connected to a second output terminal of the first rectifier Rect1. A first output terminal of the second rectifier Rect2 is connected to a first end of a second LED string LS2. A second end of second LED string LS2 is connected to a second output terminal of second rectifier bridge Rect2. In FIG. 1 Comp1 and Comp2 are schematic representations of respectively a first compartment and a second compartment comprised in an embodiment of a LED lamp according to the invention.

The LEDs of each of the LED strings LS1 and LS2 are distributed over the first compartment Comp1 and the second compartment Comp2 such that part of the LEDs of each LED string are present in the first compartment Comp1 and the remainder of the LEDs of each LED string is present in the second compartment Comp2.

The operation of the LED light source shown in FIG. 1 is as follows.

When the input terminals K1 and K2 are connected to poles of a mains supply, a first sinusoidally shaped low frequency AC voltage supplied by this mains supply is present at the input terminals of the first rectifier bridge Rect1 and is rectified into a first periodical DC voltage that is present between the output terminals of the first rectifier bridge Rect1 and thus across the first LED string LS1. A second sinusoidally shaped low frequency AC voltage is present at the input terminals of the second rectifier bridge Rect1 and is rectified into a second periodical DC voltage that is present between the output terminals of the second rectifier bridge Rect2 and thus across the second LED string LS2. The second sinusoidally shaped AC voltage is supplied by the mains supply via the capacitor C and is therefore phase shifted with respect to the first sinusoidally shaped AC voltage. As a consequence the second periodical DC voltage is also phase shifted with respect to the first periodical DC voltage. When the momentary amplitude of the first periodical DC voltage is too low to cause a current to flow through the first LED string LS1, due to the phase shift the momentary amplitude of the second periodical DC voltage is high enough to cause a current to flow through the second LED string LS2. As a consequence, at any moment in time one of the LED strings is always carrying a current and thus generating light. Since the LEDs of each LED string are distributed over the compartments Comp1 and Comp2, at any moment in time light is generated in each compartment. For this reason stroboscopic effects are prevented.

Figure 2B:
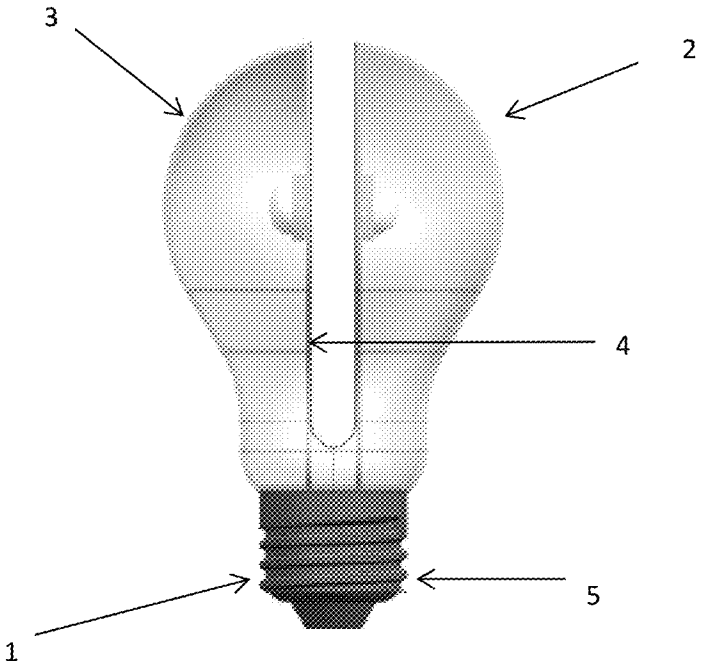
FIG. 2A and FIG. 2B show an embodiment of a LED lamp according to the invention.
Figure 2A:
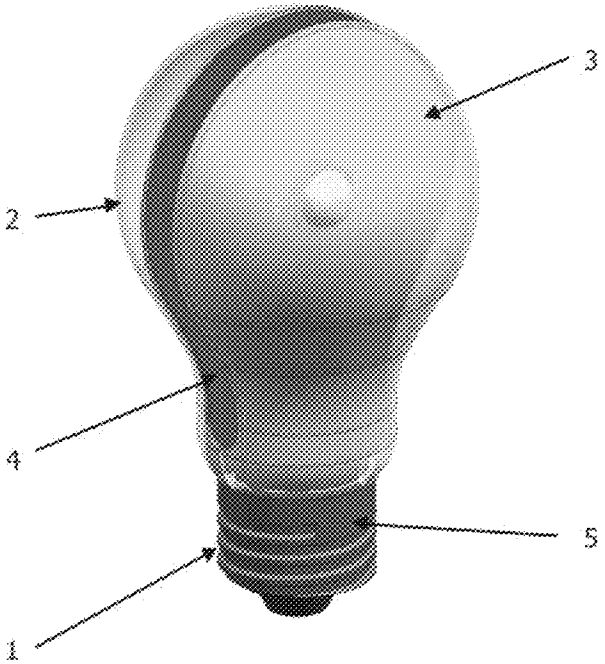

In FIG. 2 a LED lamp is shown that has the shape of an incandescent lamp. The lamp has a lamp cap (1) and a lamp vessel or lamp bulb (2/3) that is divided into two parts 2 and 3. Between the two parts a heat sink 4 is present that divides the space within the lamp bulb into two compartments. The LED lamp comprises a LED light source as shown in FIG. 1. In each of the compartments half of the LEDs that belong to each of the two different LED strings are present on the heat sink. The two different LED strings are connected to the mains supply in the way shown in FIG. 1. Because the first half of the LEDs in each string is present in the first compartment and the other half in the second compartment, the amounts of light generated in each of the compartments are always equal. The two rectifiers, the two resistors and the capacitor are present in the lamp cap.

Of course it is possible to choose a lamp vessel with a shape that differs from that of an incandescent lamp. It is also possible to divide the space within the lamp vessel into three or more compartments that are at least in part confined by the heatsink and the wall of the lamp vessel. The lamp may be equipped with electrical contacts that differ from a lamp cap or lamp fitting. Depending on the practical use of the lamp, it may be desirable that the light output of each compartment comprising LEDs is approximately identical. In this case the LEDs comprised in the two or more LED strings need to be distributed evenly over at least part of the compartments. In some applications it can be desirable that different compartments have different light outputs. This can be realized by unevenly distributing the LEDs comprised in the two or more LED strings over at least part of the compartments.

Figure 3A:
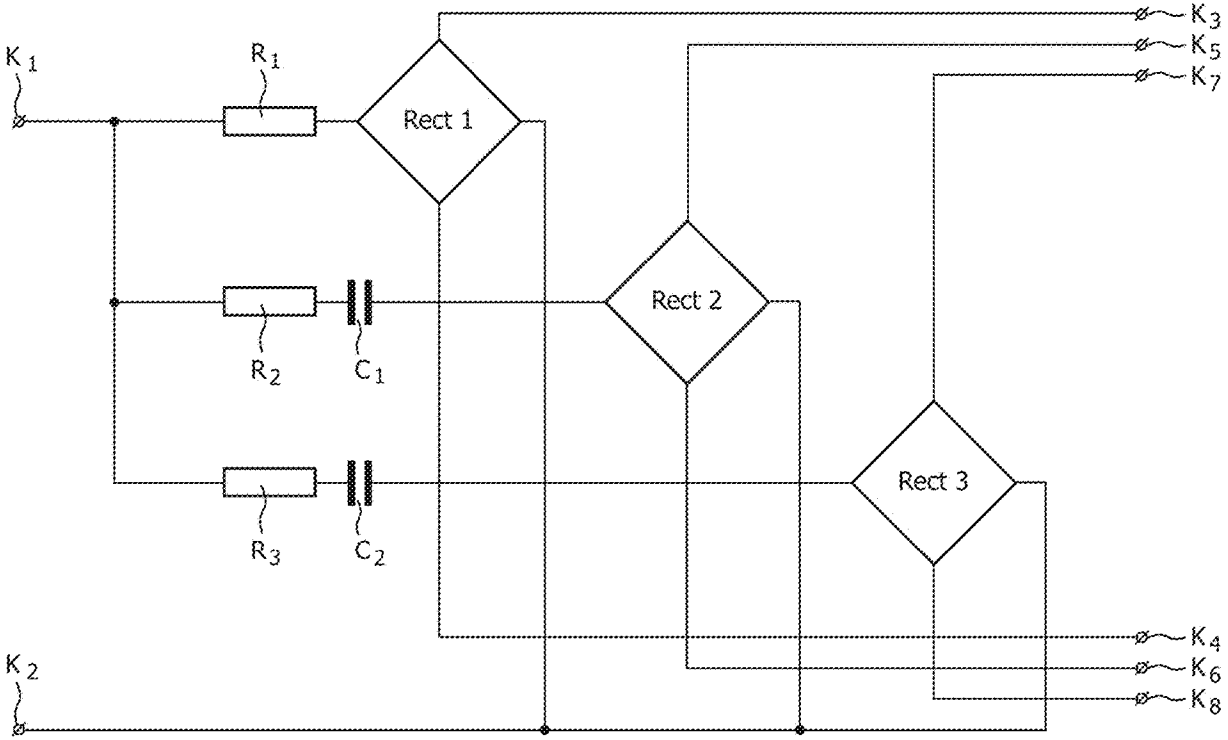
FIG. 3A shows an embodiment of circuitry supplying periodic DC voltage for LED strings.
Figure 3B:
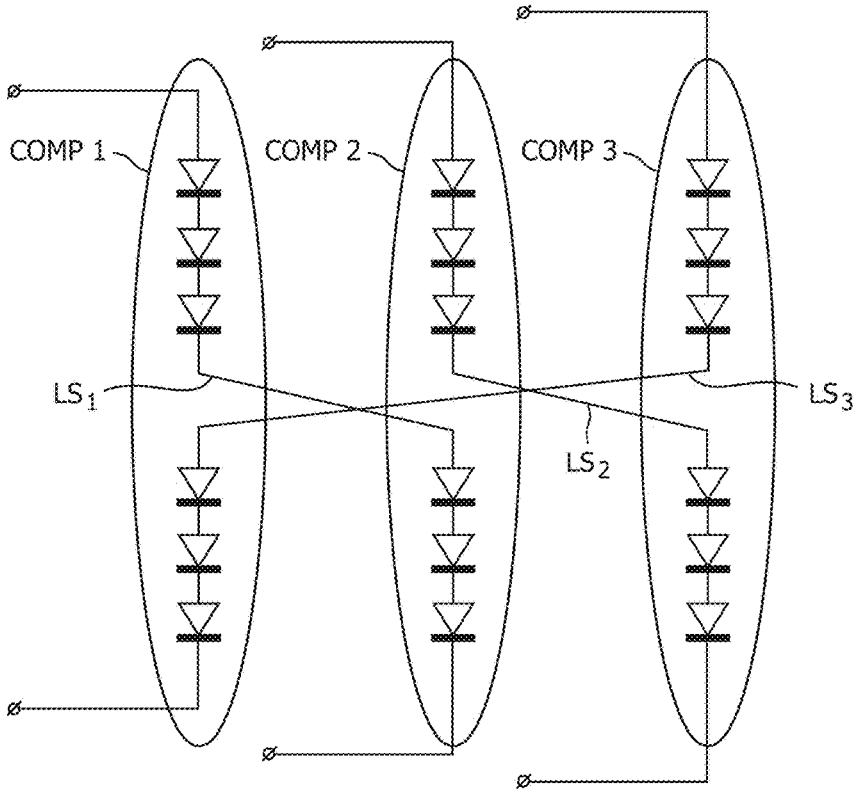
FIG. 3B shows an embodiment of a distribution of LEDs, comprised in the LED strings of an embodiment of the LED light source, over compartments comprised in an embodiment of a LED lamp according to the invention.

FIG. 3B schematically depicts a distribution of three LED strings over three compartments of a LED lamp. Each of the LED strings is supplied by a periodical DC voltage. These periodical DC voltages are generated by circuitry as shown in FIG. 3A, comprising three rectifiers (Rect1, Rect2 and Rect3) and two reactive elements C1 and C2 in the form of two capacitors. The three periodic DC voltages are present between the output terminals (K3-K8) of the three respective rectifiers. Each of these periodical DC voltages is phase shifted with respect to the two other periodical DC voltages. A first LED string LS1 is connected between output terminals K3 and K4 of rectifier Rect1. A second LED string LS2 is connected between output terminals K5 and K6 of rectifier Rect2. A third LED string LS3 is connected between output terminals K7 and K8 of rectifier Rect3. Each of the LED strings LS1, LS2 and LS3 is distributed over two of the three compartments Comp1, Comp2 and Comp3, since a first part of the LEDs is present in a compartment and the remainder of the LEDs is present in a another compartment. Each compartment comprises the same number of LEDs and therefore has the same light output during operation of the LED lamp. Lamps with three compartments generally have a better omnidirectional distribution of the generated light. Use of three phase shifted currents through three respective LED strings generally offers a light intensity that varies less over time than in case the light is generated by only two LED strings.

Figure 4:
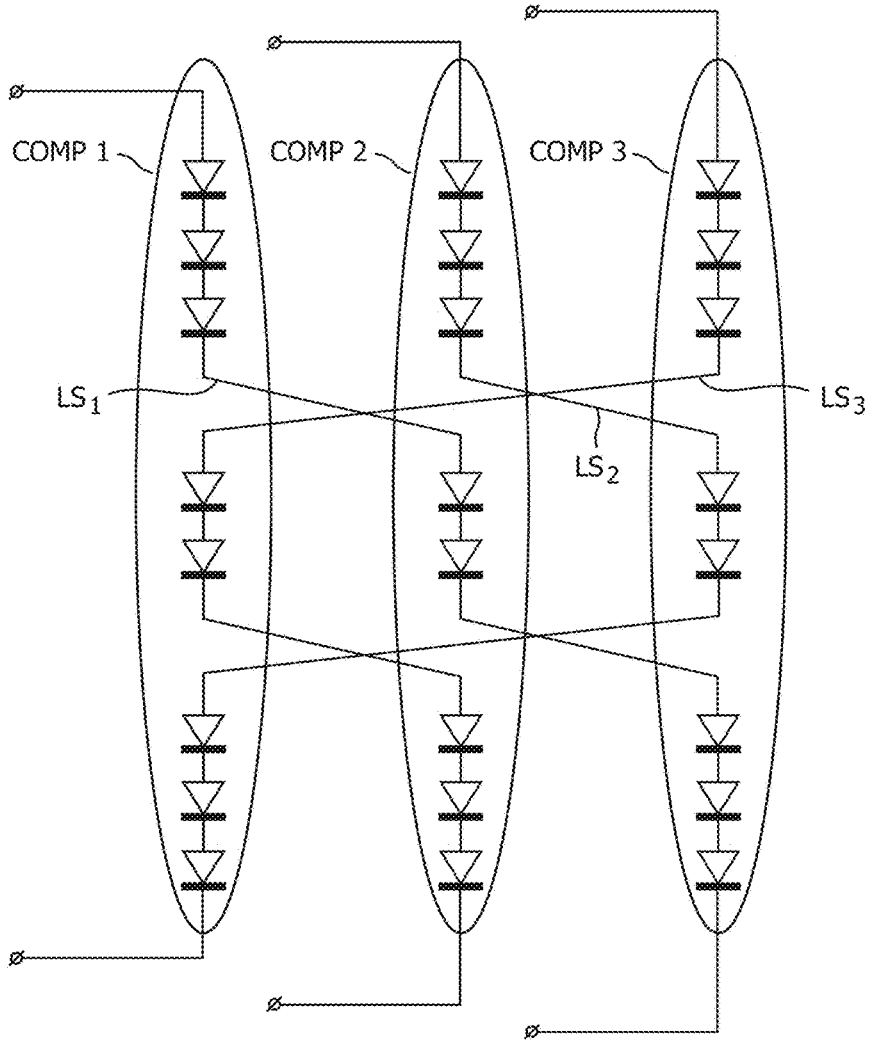
FIG. 4 shows another embodiment of a distribution of LEDs, comprised in the LED strings of an embodiment of the LED light source, over compartments comprised in an embodiment of a LED lamp according to the invention.

FIG. 4 also schematically depicts a distribution of three LED strings over three compartments of a LED lamp. The LED strings are supplied by circuitry as shown in FIG. 3A. Each of the LED strings is distributed unevenly over the three compartments since each LED string comprises 8 LEDs of which a first three are comprised in a first compartment, a second three in a second compartment and the remaining two in a third compartment. Each of the three compartments comprises the same number of LEDs so that the total number of LEDs comprised in the three LED strings is evenly distributed over the three compartments.

Figure 5:
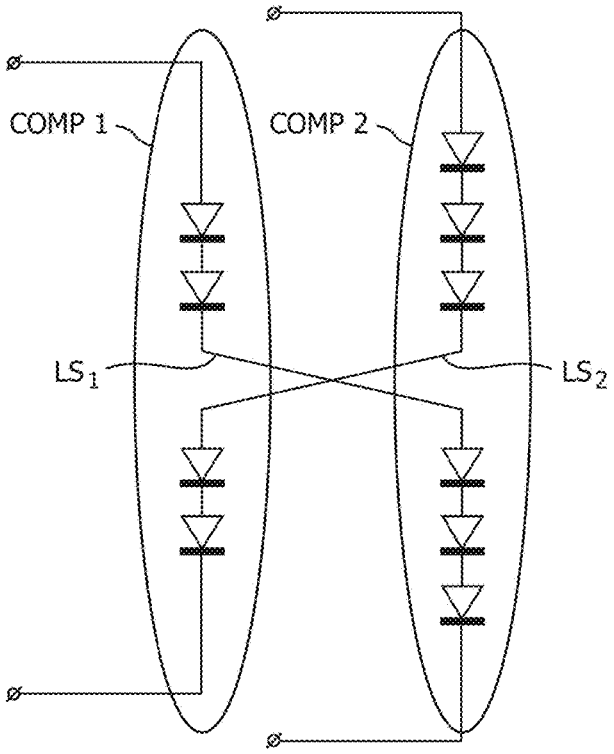
FIG. 5 shows another embodiment of a distribution of LEDs, comprised in the LED strings of an embodiment of the LED light source, over compartments comprised in an embodiment of a LED lamp according to the invention.

FIG. 5 schematically depicts a distribution of two LED strings over two compartments of a LED lamp. Like in FIG. 1 each LED string is supplied by a periodical DC voltage. The two periodical DC voltages are phase shifted with respect to each other. Of each LED string part of the LEDs is present in a first compartment and the remainder is present in a second compartment. Of the total number of LEDs comprised in the two strings a higher portion is present in the first compartment than in the second compartment. As a consequence, the light output of the first compartment during operation is higher than that of the second compartment. However, since each compartment comprises LEDs belonging to both LED strings, stroboscopic artefacts are suppressed to a large extent. The light generated in the first compartment can for instance be used to lighten a desk while the light generated in the second compartment can be used to lighten the surroundings of the desk.

Figure 6:
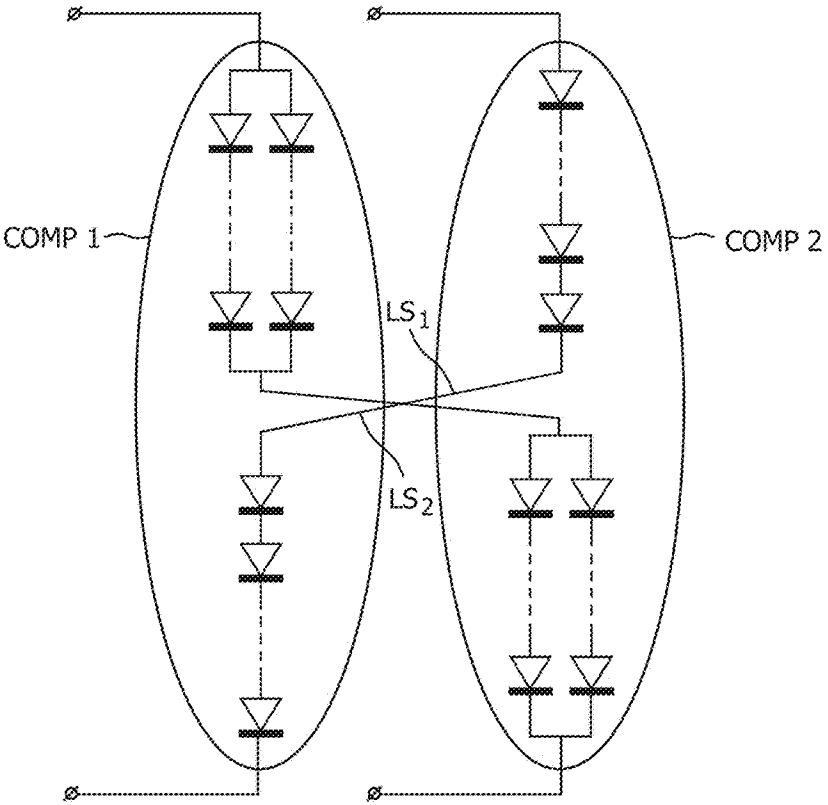
FIG. 6 shows another embodiment of a distribution of LEDs, comprised in LED strings of an embodiment of a LED light source according to the invention, over compartments comprised in an embodiment of a LED lamp according to the invention.

FIG. 6 shows two LED strings distributed over two compartments. The two LED strings are supplied as in FIG. 1 or FIG. 5. At least part of the LEDs comprised in the second string are placed in parallel. In case this second string is connected to the output terminals of the rectifier in FIG. 1 that has a capacitor connected to its input terminal and the other string is connected to output terminals of the other rectifier, the duty cycle of the capacitive current is increased because the voltage drop across the first string is lower than in case all the LEDs are placed in series. As a consequence the voltage across the capacitor is increased and therefore the phase shift between the currents through the two strings is also increased.

The invention claimed is:

1. An LED (Light Emitting Diode) lamp comprising:

a lamp vessel, a heat sink at least partially disposed within the lamp vessel, the space surrounded by the lamp vessel being divided into a number of compartments, each of which is at least in part confined by a wall of the lamp vessel and the heat sink, the plurality of compartments including a first compartment and a second compartment; and an LED light source comprising a plurality of LED strings, each LED string of the plurality of LED strings comprising a plurality of LEDs in thermal communication with the heat sink, wherein the plurality of LED strings includes a first LED string and a second LED string, wherein the LEDs of the first LED string are distributed over the first and second compartments, and the LEDs of the second LED string are distributed over the first and second compartments;

wherein a current through the first LED string is interrupted at a zero crossing of an AC power source and a current through the second LED string is interrupted at a phase-shifted zero crossing of the AC power source, wherein the distribution of the first and second LED strings over the first and second compartments prevents stroboscopic artifacts resulting from the interrupted currents through the first LED string and the second LED string.

2. The LED light source as claimed in claim 1, further comprising a first rectifier and a second rectifier, the first and second rectifiers respectively having a first and a second input terminal and output terminal, the first input terminal of the second rectifier being coupled to the first input terminal of the first rectifier via a reactive element and the second input terminal of the second rectifier being coupled to the second input terminal of the first rectifier, wherein the first LED string is coupled between the output terminals of the first rectifier and the second LED-string is coupled between the output terminals of the second rectifier.

3. The LED light source as claimed in claim 1, wherein at least part of the LEDs comprised in the second LED string are connected in parallel.

4. An LED lamp, comprising:

a lamp cap, a lamp bulb, comprising an outer enclosure, connected to the lamp cap and divided into two or more parts, a heat sink located between the parts of the lamp bulb and dividing a space within the lamp bulb into a number of compartments equal to the number of parts of the lamp bulb, wherein each compartment is located within a respective part of the lamp bulb, wherein the heat sink comprises at least two heat sink walls, wherein the heat sink walls define a portion of the outer enclosure, wherein the heat sink walls further define a cavity positioned between the two or more parts of the lamp bulb such that the cavity is positioned outside the outer enclosure;

a LED light source comprising at least two strings, each comprising a plurality of LEDs in thermal communication with the heat sink, wherein the LEDs comprised in each of the LED strings are connected to the heat sink and are distributed over the compartments wherein a current through a first LED string is interrupted at a zero crossing of an AC power source and a current through a second LED string is interrupted at a phase-shifted zero crossing of the AC power source, wherein the distribution of the first and second LED strings over the compartments prevents stroboscopic artefacts resulting from the interrupted currents through the first LED string and the second LED string.

5. The LED lamp as claimed in claim 1, wherein a voltage applied to the first LED string is phase shifted with respect to a voltage applied to the second LED string.

6. The LED light source as claimed in claim 1, wherein the plurality of compartments further includes a third compartment, wherein the plurality of LED strings further includes a third LED string, wherein the LEDs of the first and second LED strings are further distributed over the third compartment, and wherein the LEDs of the third LED string are distributed over the first, second and third compartments.

7. The LED light source as claimed in claim 5, wherein the phase shift is 90 degrees.

* * * * *